United States Patent [19]

Ito

[11] Patent Number: 4,810,847

[45] Date of Patent: Mar. 7, 1989

[54] LOAD APPLICABILITY DETECTING DEVICE FOR INDUCTION-HEATING COOKING APPARATUS

[75] Inventor: Susumu Ito, Aichi, Japan

[73] Assignee: Kabushiki Kaisha Toshiba, Kawasaki, Japan

[21] Appl. No.: 155,087

[22] Filed: Feb. 11, 1988

[30] Foreign Application Priority Data

Jul. 23, 1987 [JP] Japan ..... 62-183948

[51] Int. Cl.[4] ..... H05B 6/06

[52] U.S. Cl. ..... 219/10.77; 219/10.493; 323/901; 363/49

[58] Field of Search ..... 219/10.77, 10.75, 10.491, 219/10.493; 363/49, 97, 98; 323/901

[56] References Cited

U.S. PATENT DOCUMENTS

| | | | |
|---|---|---|---|
| 3,781,505 | 12/1973 | Steigerwald | 219/10.49 R |
| 4,180,852 | 12/1979 | Koizumi et al. | 363/49 |
| 4,317,016 | 2/1982 | Ito | 219/10.49 R |
| 4,338,503 | 7/1982 | Ito et al. | 219/10.77 |
| 4,356,371 | 10/1982 | Kiuchi et al. | 219/10.77 |
| 4,467,165 | 8/1984 | Kiuchi et al. | 219/10.77 |
| 4,599,504 | 7/1986 | Ito | 219/10.77 |
| 4,617,442 | 10/1986 | Okuda | 219/10.77 |
| 4,625,271 | 11/1986 | Chetty et al. | 363/49 |
| 4,686,340 | 8/1987 | Fukasawa | 219/10.77 |

FOREIGN PATENT DOCUMENTS

| | | |
|---|---|---|
| 50-85940 | 7/1975 | Japan . |
| 56-69793 | 6/1981 | Japan . |

*Primary Examiner*—Philip H. Leung

*Attorney, Agent, or Firm*—Foley & Lardner, Schwartz, Jeffery, Schwaab, Mack, Blumenthal & Evans

[57] ABSTRACT

A load applicability detecting device for induction-heating cooking apparatus includes a heating coil for an heating metallic cooking pans by means of electromagnetic induction, an inverter supplying the heating coil with high frequency currents, a soft starter for gradually decreasing an output frequency of the inverter at the time of the starting of the inverter, an input current detector for detecting the inverter input current at an initial stage of the starting of the inverter to obtain a detection signal, a reference signal generator for generating a reference signal in synchronization with the starting of the inverter, the level of the reference signal being varied with a predetermined time constant, and a comparator for comparing a detection signal generated by the input current detector with the reference signal generated by the reference signal generator to produce a load applicability detection signal in accordance with the difference between the levels of the detection signal and the reference signal.

1 Claim, 4 Drawing Sheets

LOAD APPLICABILITY DETECTING DEVICE FOR INDUCTION-HEATING COOKING APPARATUS

BACKGROUND OF THE INVENTION

1. Field of the Invention

The present invention relates to an induction-heating cooking apparatus wherein loads such as a cooking pan containing food to be cooked are heated, and more particularly to a load applicability detecting device for the induction-heating cooking apparatus.

2. Description of the Prior Art

In conventional induction-heating cooking apparatus, high frequency currents are fed to a heating coil from an inverter so that high frequency magnetic fields are generated around the heating coil, thereby heating a load such as a cooking pan containing food to be cooked. The induction-heating cooking apparatus is provided with a detecting circuit for determining whether or not the load is applicable to the electromagnetic induction-heating so that the cooking pan formed of material unapplicable to the electromagnetic induction-heating or small cooking pans are prevented from being applied unconsciously, or that forks, kitchen and table knives or the like are prevented from being mistakenly heated. Such load applicability detecting circuits are classified into two types. One of the types relies upon an input current to the inverter being approximately proportional to the bottom area of the load. The other type relies upon the input current to the inverter and a high frequency voltage output of the inverter showing different characteristics in accordance with various loads.

In the former type, however, when an output of the inverter is manually set at "LOW" with an inverter output setting means, relatively small cooking pans are not heated when applied. Furthermore, since a detection level of the load applicability detecting circuit is changed in accordance with the inverter output set with the inverter output setting means, a long period of time is required to detect the applicability of the load when the inverter output is set at a high level. Consequently, heat is applied to the small load for a long time, so that the temperature of the load is abnormally increased.

Whereas, in the latter type, the determination is made whether or not the load is too small for induction-heating based on the characteristic that the input current to the inverter is varied with respect to various kinds of loads, though the output voltage of the inverter is maintained at an approximately given value. However, when the value set by the inverter output setting means is small, the input current to the inverter varies little in accordance with various loads. Consequently, detection of the applicability of small loads is difficult.

SUMMARY OF THE INVENTION

Therefore, a first object of the present invention is to provide an improved load applicability detecting device for the induction-heating cooking apparatus wherein the load applicability detecting operation is performed in a short period of time irrespective of the set inverter output value so that the load is prevented from being excessively heated during the operation of the load applicability detecting device.

A second object of the present invention is to provide an improved load applicability detecting device for the induction-heating cooking apparatus wherein the load applicability detecting operation is performed stably even where the output of the inverter is set at any value.

According to a first aspect of the present invention, the load applicability detecting device for the induction-heating cooking apparatus comprises a heating coil for heating metallic cooking pans by means of electromagnetic induction, an inverter supplying the heating coil with high frequency currents, soft starting means for gradually decreasing an output frequency of the inverter from a predetermined large value to a predetermined small value for a predetermined short period of time so that an inverter input current gradually rises for a period of the starting of the inverter, input current detecting means for detecting the inverter input current at an initial stage of the starting of the inverter, thereby obtaining a detection signal (E18), the level of which is in accordance with that of the inverter input current, reference signal generating means for generating a reference signal (E28) in synchronization with the starting of the inverter, the level of the reference signal (E28) being varied with a predetermined time constant, means for comparing the detection signal (E18) generated by the input current detecting means with the reference signal (E28) generated by the reference signal generating means, thereby producing a load applicability detection signal in accordance with the difference between levels of the detection signal (E18) and the reference signal (E28), and means for deenergizing the inverter when the load applicability detection signal represents that the load is unapplicable to the induction-heating.

According to the first aspect of this invention, the manner of starting the inverter is such that the output frequency of the inverter is gradually decreased from the large value to the value of a set frequency corresponding to the value of the inverter output set, for a short period of time. This starting manner of the inverter will hereinafter be referred to a "soft starting." As the result of the soft starting, the input current to the inverter is gradually increased for the time period of the starting of the inverter. The rise waveform of a detection signal (E18) generated by the input current detecting means takes the form gradually increased with the gradual increase of the input current to the inverter.

Whereas, a reference signal (E28) is generated by the reference signal generating means at the same time as the starting of the inverter. The rise waveform of the reference signal (E28) is rendered similar to that of the detection signal (E18) by application of a time constant circuit.

Peak levels of the above-described gradually increased rise waveforms are the value determined in accordance with the load with respect to the detection signal (E18) and a threshold with respect to the reference signal (E28).

The detection signal (E18) is compared with the reference signal (E28) by a comparator means with the gradually increased waveforms maintained. When the relation between these signals is shown as E18>E28, a load applicability detection signal representing that the load is unapplicable to the induction heating, is generated.

Consequently, the load applicability detecting operation is performed during the soft starting of the inverter.

According to a second aspect of the invention, the load applicability detecting device comprises a heating coil for heating a metallic cooking pan by means of electromagnetic induction, an inverter supplying the heating coil with high frequency currents, soft starting means for gradually decreasing an output frequency of the inverter from a predetermined large value to a predetermined small value for a predetermined short period of time so that an inverter input current gradually rises for a time period of the starting of the inverter, input current detecting means for detecting the inverter input current at an initial stage of the starting of the inverter to obtain a detection signal (E18), the level of which is in accordance with that of the inverter input current, a power source switch operated prior to the starting of the inverter, a first integrating circuit starting an integrating operation when the power source switch is operated, the first integrating circuit generating a first timing signal (S3) when an integrated output (E43) thereof reaches a first level, control means for supplying the inverter with a starting signal (S1) when receiving the first timing signal (S8) from the first integrating circuit, a second integrating circuit starting an integrating operation when receiving the first timing signal (S1) from the first integrating circuit, the second integrating circuit generating a reference signal (E28), the level of which is gradually increased toward a predetermined reference level (VO), and means for comparing the detection signal (E18) from the input current detecting means with the reference signal (E28) from the second integrating circuit to thereby cause the control means to generate an inverter deenergization signal when the level of the reference signal (E28) is higher than that of the detection signal (E18).

According to the second aspect of the invention, the starting of the inverter is automatically commenced with a predetermined delay period of time by a first integrating circuit after turn-on of a power source switch. Simultaneously, a reference signal (E28) having gradually increasing rise waveform is generated by the second integrating circuit.

Other and further objects of this invention will become obvious upon an understanding of the illustrative embodiment about to be described as will be indicated in the appended claims, and various advantages not referred to herein will occur to one skilled in the art upon employment of the invention in practice.

DESCRIPTION OF THE PREFERRED EMBODIMENT

An embodiment of the load applicability detecting device in accordance with the present invention will now be described with reference to the drawings. In the embodiment, the load applicability detecting device takes the form of an electric circuit.

Figure 1:
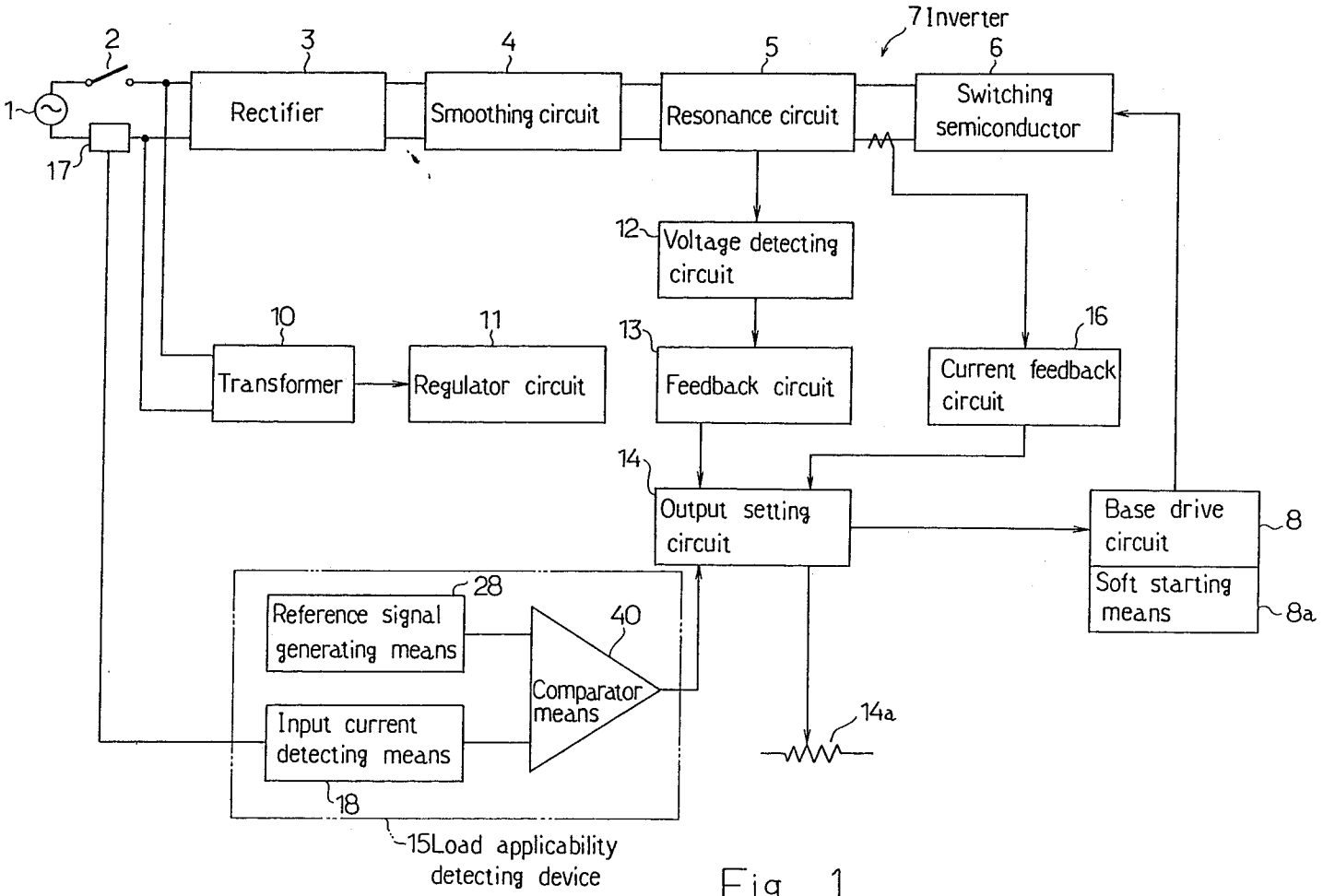
FIG. 1 is a block diagram illustrating circuit arrangements of an induction-heating cooking apparatus incorporating the load applicability detecting device in accordance with the present invention.

Referring first to FIG. 1, reference numeral 1 indicates a commercial power source. Numeral 2 indicates a power source switch. A rectifier 3 is provided for rectifying an electrical power from the AC power source to DC power. A smoothing circuit 4 comprises a reactor and a capacitor. A resonance circuit 5 comprises a heating coil 9 (see FIG. 3) and a resonance capacitor (not shown). The resonance circuit 5 and a switching semiconductor 6 constitute an inverter 7. An on-period of the switching semiconductor 6 is controlled by a base drive circuit 8. Upon energization of the switching semiconductor 6, the inverter 7 inverts DC currents to AC currents at the resonant frequency point, thereby feeding high frequency currents to the heating coil 9. A transformer 10 is provided for dropping the voltage of the AC power source 1. A regulator circuit 11 is provided for regulating the secondary output of the transformer 10 to obtain a control power source. The control power source is applied to the control circuit except an inverter main circuit. A voltage detecting circuit 12 is provided for detecting voltages at terminals of the heating coil 9 of the resonance circuit 5. A feedback circuit 13 is provided for feedback-controlling the timing (voltage changing timing) of the output signal from the voltage detecting circuit 12, thereby controlling an operation timing of the switching semiconductor 6. An output setting circuit 14 is provided for setting an output power of the inverter 7 by changing the inverter output frequency. Based on a set signal from a setting switch **14*a* manually operated by a user, the inverter output setting circuit 14 receives a signal from a load applicability detecting device 15 which will hereinafter be described in detail, a signal from the feedback circuit 13, and a signal from a current feedback circuit 16 for detecting a reverse current through the switching semiconductor 6 for the protection of the same, whereby the inverter output setting cirucit 14 generates a drive control signal which is supplied to the base drive circuit 8**.

The base drive circuit 8 includes a soft starting means **8*a* wherein the output frequency of the inverter 7 is gradually decreased from a preset large value to a value set with the setting switch 14*a* for about 0.2 second while the inverter 7 is being started. Consequently, the inverter input current is gradually increased. Since the foregoing circuit arrangement except the load applicability detecting circuit 15** is well known in the art as that of an inverter provided in the induction-heating cooking apparatus, the description will not go further.

The load applicability detecting circuit 15 will now be described with reference to FIG. 2. Reference numeral 18 indicates an input current detecting means which comprises a current transformer 17 provided at the AC current side of the inverter 7. The detected current supplied from the current transformer 17 is converted to the corresponding DC voltage by a capacitor 19, resistors 20 and 23, diode 21 and smoothing capacitor 22. The converted DO voltage is supplied to a non-inversible input terminal (+) of an operational amplifier 25 through a resistor 24. The operational amplifier 25 is utilized as a negative feedback amplifier wherein an amplification factor thereof is determined by feedback resistors **25*a* and 25*b*. An output signal E18 as input current detection signal is supplied to a non-inversible input terminal (+) of a comparator 41 of a comparing means 40 described hereafter through the connection point of a resistor 26 and a smoothing capacitor 27**.

Reference numeral 28 indicates a reference signal generating means. A reference voltage producing circuit 29 comprises voltage dividing resistors 30 and 31 serially connected between the DO power source $V_{DD}$ and the ground potential point. The reference voltage is supplied from the reference voltage producing circuit 29 to a non-inversible input terminal (+) of the comparator 82 and a non-inversible input terminal (+) of the comparator 50 of the comparator means 40. A parallel circuit comprising a capacitor 38 and an instantaneous discharge resistor 34 is connected between an inversible input terminal (−) of the comparator 32 and the ground potential point. A second integrating circuit 35 comprises a resistor 36 and a capacitor 37. The connection point of the integrating circuit 35 is connected to an output terminal of the comparator 32 through a resistor 38. A resistor 39 is provided for setting the voltage in the stable state of the integrating circuit 35, in cooperation with the resistor 38. The time constant of the integrating circuit 35 is determined as, for example, 0.2 second in accordance with the soft starting period of the inverter 7, which period will hereinafter be described in detail. Accordingly, the reference signal generating means 28 generates the output signal from the integrating circuit 35 as a reference signal E28. As described above, the output signal (or detection signal) E18 from the input current detecting means 18 is supplied to the non-inversible input terminal (+) of the comparator 41. The reference signal E28 from the reference signal generating means 28 is supplied to the inversible input terminal (−) of the comparator 41. A first integrating circuit 45 comprising resistors 42, 44 and a capacitor 43 is connected to an output terminal of the comparator 41. An output of the first integrating circuit 45 is supplied to an inversible input terminal (−) of a comparator 49 forming a hysteresis circuit together with resistors 46, 47 and 48. An output of the comparator 49 is supplied to an inversible input terminal (−) of a comparator 50 serving as an inverter control means and to the inversible input terminal (−) of the comparator 32 of the reference signal generating means 28 through a diode 51. An output of the comparator 50 serves as either an inverter energization signal S1 or inverter deenergization signal S2, both of which are supplied to the output setting circuit 14. When the output of the comparator 50 is turned to the high level, the output setting circuit 14 acts to energize the inverter 7. The inverter 7 is deenergized when the output of the comparator 50 is turned to the low level.

Figure 5:
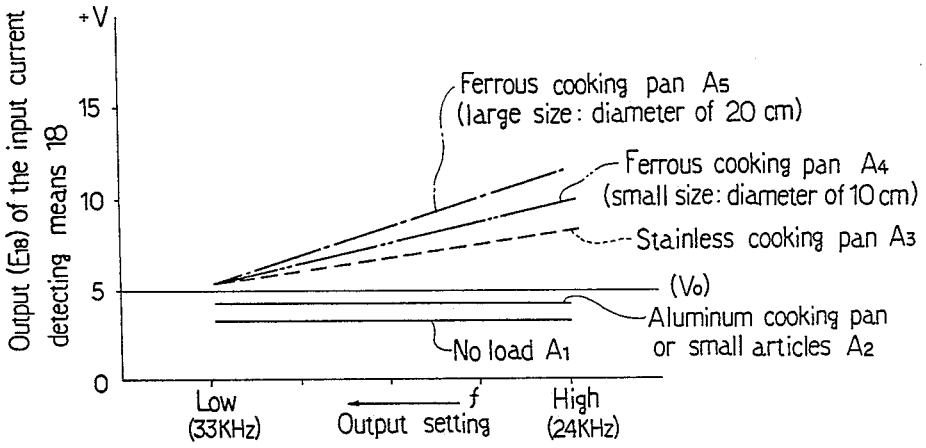
FIG. 5 shows relations between the level of the detection signal and a set output relative to various kinds of loads.

FIG. 5 illustrates relations between the values of the inverter output set by changing the inverter output frequency by the output setting circuit 14 and the level of the output signal E18 of the input current detecting means 18 in accordance with materials and dimensions of certain loads. From FIG. 5, it is understood that the level of the output signal E18 is not almost changed with changes of the inverter output when the aluminum cooking pan having small real resistance owing to its small magnetic permeability or when the load is extremely small-sized, as shown by line A2. On the other hand, the level of the output signal E18 is increased with the increase of the inverter output when a cooking pan formed of material having large magnetic permeability or a large-sized cooking pan is employed as load, as shown by lines A3, A4 and A5.

In accordance with the present invention, a reference level (or threshold) is provided for discriminating the loads unapplicable to the induction-heating as shown by line A2 from the loads applicable to the induction-heating. The reference level is determined so as to take a value VO of the output signal E18, which value VO is approximated to the line A2. Accordingly, the peak value of the reference signal E28, the level of which is changed with a predetermined time constant, is set at VO.

Figure 3:
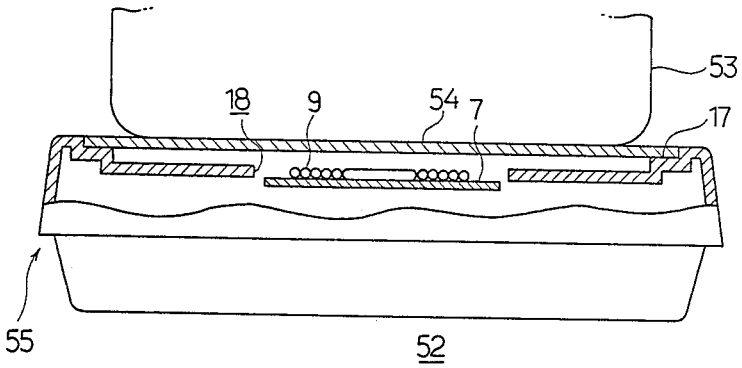
FIG. 3 is a partially cutaway side view of the induction-heating cooking apparatus.

FIG. 3 illustrates an induction-heating cooking apparatus incorporating the circuit shown in FIG. 1. The cooking apparatus comprises a cabinet 55 on which a top plate 54 is provided for receiving a cooking pan 53. The heating coil 9 is provided at the underside of the top plate 54 so as to be close thereto.

Operation of the load applicability detecting circuit 15 will now be described. In the circuit arrangement described above, when the inverter 7 is not driven, that is, when the induction heating operation is not executed, the level difference between the output signal E18 from the input current detecting means 18 and the reference signal E28 from the reference signal generating means 28 is maintained at a constant value with the relation of E18 > E28, as is understood from (F) and (G) of FIG. 4 illustrating signal waveforms at various points (a)-(g) in the circuit shown in FIG. 2.

Figure 2:
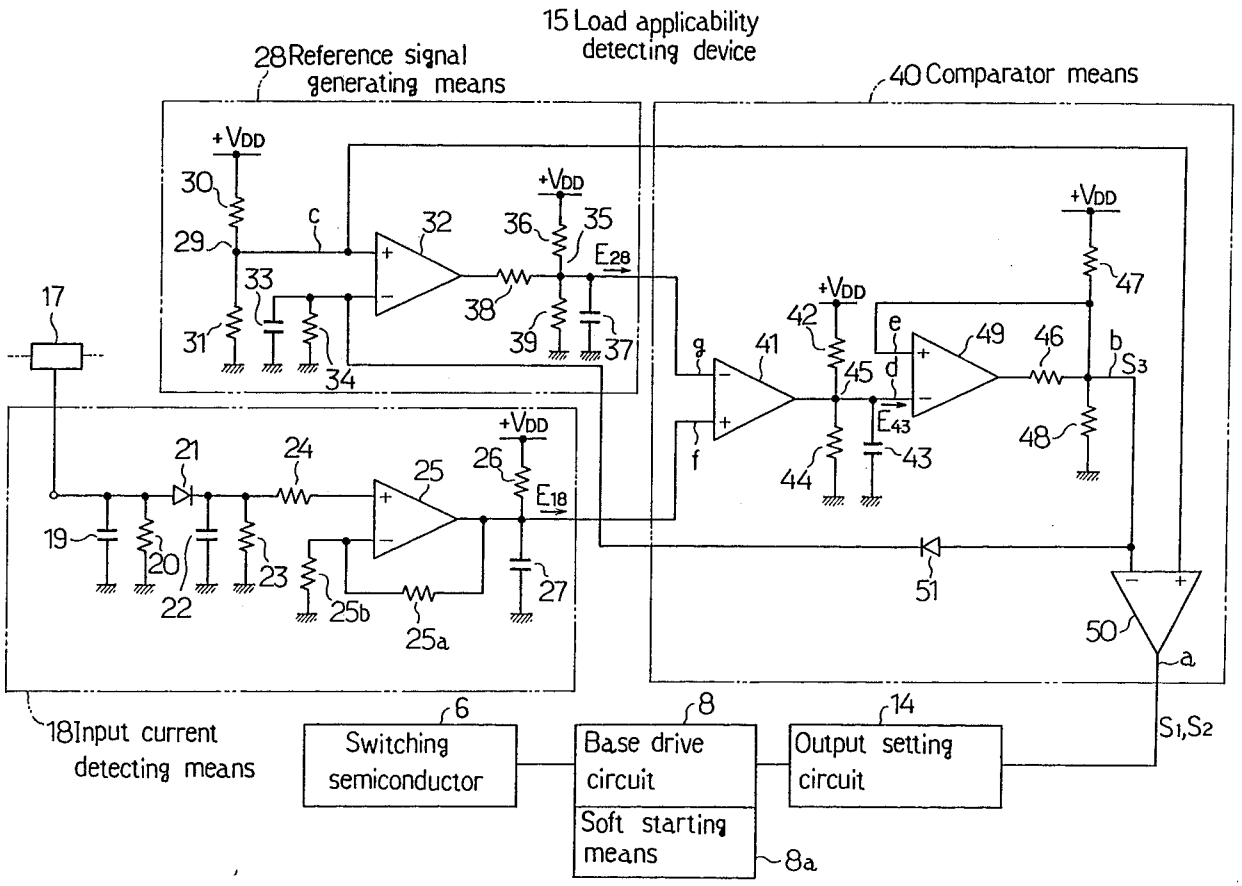
FIG. 2 is a circuit diagram of the load applicability detecting device.
Figure 4:
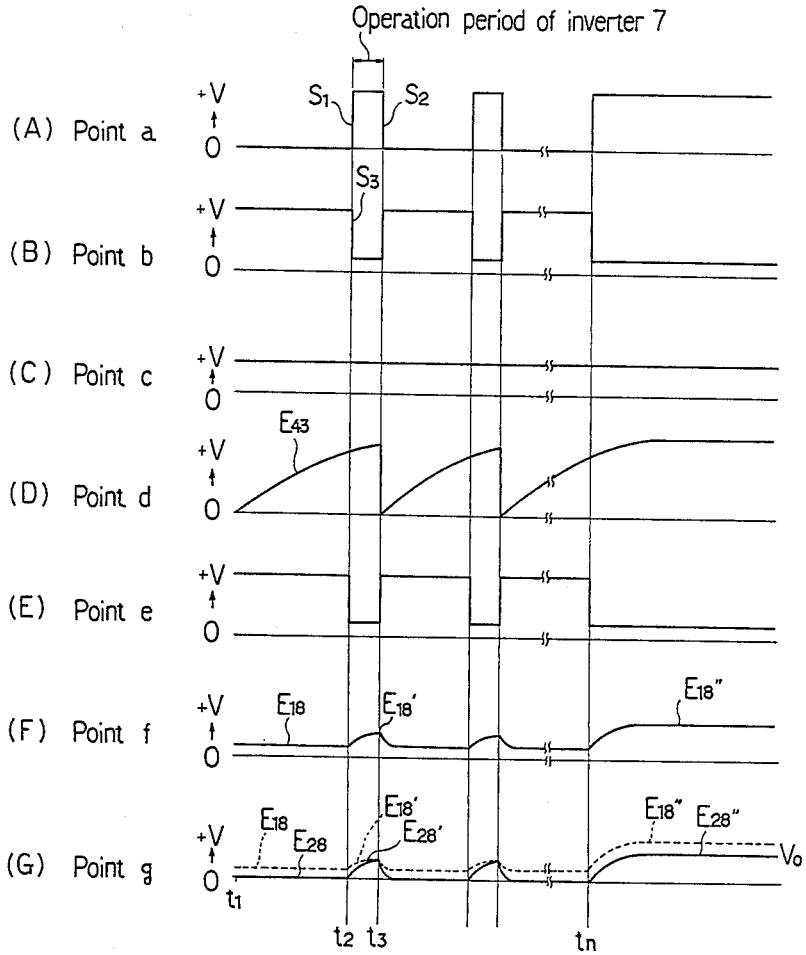
FIG. 4 shows voltage waveforms at various points of the load applicability detecting device.

The voltage level at each point in FIG. 2 is shown as that at time point t1 in FIG. 4 in the initialized state that the power supply switch 2 is turned on to supply each circuit with the control power at time point t1. An output signal E18 from the input current detecting means 18 and a reference signal E28 from the reference signal generating means 28 are supplied to the comparator 41 of the comparator means 40. Since the level of the output signal E18 is higher than that of the reference signal E28, the output of the comparator 41 is turned to the high level. Consequently, the integrating circuit 45 starts its integration operation as shown by FIG. 3(D) and gradually increased integrated output signal E43 is supplied to the inversible input terminal (−) of the comparator 49. Since an integrated output E43 from the integrating circuit 45 exceeds the level of an input (a first set level) supplied to the non-inversible input terminal (+) of the comparator 49 at time point t2, the output of the comparator 49 is turned to the low level (a first timing signal S3). Consequently, the output of the comparator 50 is turned to the high level (an inverter starting signal S1). The inverter starting signal S1 is supplied to the output setting circuit 14 as shown by FIG. 4(A), whereby the inverter 7 starts its operation at time point t2. Since the soft starting is applied to the inverter 7 so that the output frequency thereof is gradually decreased by the soft starting means 8*a*, the input current to the inverter 7 is gradually increased toward the peak value depending upon the load. The detection signal E18′ generated by the input current detecting means 18 represents gradually increasing rise waveforms as shown by FIG. 4(F). Simultaneously, the low level output of the comparator 49 is supplied to the inversible input terminal (−) of the comparator 32 of the reference signal generating means 28 through the diode 51. The capacitor 38 is discharged through the resistor 34 and the input to the inversible input terminal (−) of the comparator 32 is instantaneously turned to the low level, whereby the output of the comparator 32 is turned to the high level in approximate synchronization with the starting of the inverter 7. Consequently, the level of the reference signal E28′ from the second integrating circuit 35 is gradually increased toward the peak value as a threshold VO under a predetermined time constant. The second integrating circuit 35 thus starts the integrating operation at time point t2 so that the same gradually increased waveforms as those of the detection signal E18′ are formed, as shown in FIG. 4(G). The starting operation of the inverter 7 increases the input current thereto and the change thereof is represented as the rise change (E18′ in FIG. 4(E)) of the output signal E18 from the input current detecting means 18. In approximate synchronization with the starting of the inverter 7, the output of the second integrating circuit 35 of the reference signal generating circuit 28, that is, the reference signal E28 rises under the predetermined time constant as shown by E28′ in FIG. 4. The levels of the reference signal E28′ and the detection signal E18′ having the respective gradually increased rise waveforms are compared by the comparator 41. When the level of the reference signal E28′ exceeds that of the detection signal EI8′ at time point t3, that is, when the determination is made that the load is unapplicable to the induction-heating, the output of the comparator 41 is turned to the low level and the output of the comparator 49 is turned to the high level. Furthermore, the output of the comparator 50 is turned to the low level (corresponding to the inverter turn-off signal S2), thereby deenergizing the inverter 7. The above-described determination operation is reiterated until the power source switch 2 is turned off, as is shown in FIG. 4.

On the other hand, when the determination is made that the load is applicable to the induction-heating, the output signal E18 from the input current detecting means 18 is changed as shown by E18″ at time point tn and from that time onward in FIG. 4 and the relation of E18″>E28″ is maintained. Accordingly, the inverter 7 is not deenergized, thereby continuing the heating operation.

According to the above-described induction-heating cooking apparatus, the load applicability detection is performed during a short period of the soft starting of the inverter 7. Consequently, the load is prevented from being exposed to excessive heat.

Furthermore, the inverter output is restricted for the period of the soft starting of the inverter 7 and the restricted value is below the low set output value, as is shown in FIG. 5. The level of the reference signal (or threshold VO) for the load applicability detection is determined within the range below the LOW output level set and is not changed in accordance with the output level set by the inverter output setting means 14. Accordingly, the load applicability detecting operation may be performed stably under the condition of any output level.

Although an in-phase amplifier circuit is employed as the input current detecting means 18, a non-inverting amplifier may be employed. In the case of the non-inverting amplifier, the integrated output of the integrating circuit is converted to a differentiated output Additionally, each of the set values employed in the foregoing embodiment is an example and may be changed.

The foregoing disclosure and drawings are merely illustrative of the principles of the present invention and are not to be interpreted in a limiting sense. The only limitation is to be determined from the scope of the appended claims.

What is claimed is:

1. A load applicability detecting device for an induction-heating cooking apparatus, comprising:

(a) a heating coil for heating metallic cooking pans by means of electromagnetic induction;

(b) an inverter comprising a switching element connected in series with said heating coil, said inverter causing a high frequency current to flow through said heating coil when the switching element is turned on and off;

(c) soft starting means for gradually decreasing an output frequency of said inverter from a predetermined large value to a predetermined small value for a predetermined short period of time by controlling an on-off cycle of the switching element so that an inverter input current is caused to gradually rise for the period of the starting of said inverter;

(d) input current detecting means connected to the AC input side of said inverter for detecting the inverter input current at an initial stage of the starting of said inverter, thereby obtaining a detection signal, the level of which is in accordance with that of the inverter input current;

(e) a power source switch operated prior to the starting of said inverter for supplying a switching element control circuit with a control power source;

(f) a first integrating circuit starting an integrating operation when said power source switch is operated, said first integrating circuit generating a first timing signal when an integrated output thereof reaches a first level;

(g) control means for supplying said inverter with a starting signal so that the on-off operation of the switching element is started when receiving the first timing signal from said first integrating circuit, thereby starting said inverter;

(h) a second integrating circuit starting the integrating operation when receiving the first timing signal from said first integrating circuit, said second integrating circuit generating a reference signal, the level of which is gradually increased toward a predetermined reference value; and (i) comparing means for comparing the detection signal from said input current detecting means with the reference signal from said second integrating circuit, thereby causing said control means to generate an inverter turn-off signal when the level of the reference signal is higher than that of the detection signal.

* * * * *